US006364471B1

(12) United States Patent
Seccombe

(10) Patent No.: US 6,364,471 B1
(45) **Date of Patent: *Apr. 2, 2002**

(54) FLUID ACCUMULATOR FOR INK-JET PRINT HEADS

(75) Inventor: S. Dana Seccombe, Foster City, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/363,958

(22) Filed: Jul. 29, 1999

Related U.S. Application Data

(63) Continuation of application No. 08/549,106, filed on Oct. 27, 1995, now Pat. No. 5,980,028.

(51) Int. Cl.[7] ..... B41J 2/175
(52) U.S. Cl. ..... 347/85
(58) Field of Search ..... 347/85, 86, 87; 137/907; 222/95, 103

(56) References Cited

U.S. PATENT DOCUMENTS

| | | | | |
|---|---|---|---|---|
| 4,223,323 A | | 9/1980 | Bader et al. | |
| 5,153,612 A | | 10/1992 | Dunn et al. | |
| 5,453,772 A | | 9/1995 | Aono et al. | 347/87 |
| 5,504,511 A | | 4/1996 | Nakajima et al. | 347/86 |
| 5,583,545 A | * | 12/1996 | Pawlowski et al. | 347/86 |
| 5,719,609 A | * | 2/1998 | Hauck et al. | 347/85 |
| 5,980,028 A | * | 11/1999 | Seccombe | 347/85 |

FOREIGN PATENT DOCUMENTS

| | | | |
|---|---|---|---|
| JP | 62-225352 A | 10/1987 | B41J/3/04 |

* cited by examiner

*Primary Examiner*—Judy Nguyen
(74) *Attorney, Agent, or Firm*—Raymond A. Jenski

(57) ABSTRACT

An ink-jet printing system having a pressure regulator that changes the volume of the ink receptacle as the ink pressure changes relative to the ambient pressure so that the ink remains at a substantially constant pressure for delivery to the print head.

8 Claims, 6 Drawing Sheets

FLUID ACCUMULATOR FOR INK-JET PRINT HEADS

CROSS REFERENCE TO RELATED APPLICATION(s)

This is a continuation of application Ser. No. 08/549,106 filed on Oct. 27, 1998 now U.S. Pat. No. 5, 980,028.

BACKGROUND OF THE INVENTION

The present invention relates generally to the field of ink-jet printing and, more particularly, to the delivery of ink and the control of ink pressures to ink-jet print heads.

Ink-jet technology is relatively well developed. The basics of this technology are described by W. J. Lloyd and H. T. Taub in "Ink-Jet Devices," Chapter 13 of *Output Hardcopy Devices* (Ed. R. C. Durbeck and S. Sherr, Academic Press, San Diego, 1988) and in various articles in the *Hewlett-Packard Journal*, Vol. 36, No. 5 (May 1985), Vol. 39, No. 4 (August 1988), Vol. 39, No 5. (October 1988), Vol. 43, No. 4, (August 1992), Vol. 43, No. 6 (December 1992) and Vol. 45. No. 1 (February 1994).

The typical thermal ink-jet print head has an array of precisely formed nozzles attached to a print head substrate that incorporates an array of firing chambers that receive liquid ink (i.e., colorants dissolved or dispersed in a solvent) from an ink reservoir. Each chamber has a thin-film resistor, known as a "firing resistor", located opposite the nozzle so ink can collect between it and the nozzle. When electric printing pulses heat the thermal inkjet firing resistor, a small portion of the ink near it vaporizes and ejects a drop of ink from the print head. The nozzles are arranged in a matrix array. Properly sequencing the operation of each nozzle causes characters or images to form on the paper as the print head moves past the paper.

An ink delivery system delivers ink at a slight vacuum, known as a "back pressure", to the print head so that the ink does not leak out of the nozzles. Without such back pressure, the ink may leak or "drool" out of the nozzles and onto the printing medium or into the printer mechanism. This back pressure, however, must be small enough so that when the firing resistors are energized, the resistors can overcome the back pressure and eject ink droplets in a consistent and predictable manner. Typically, this vacuum is approximately two to three inches 0f water below atmospheric pressure or minus two to three inches.

Back pressure regulation has become more critical in recent years because of the evolution in the design of print cartridges. The mass of the moving parts and the volume of ink in motion are being reduced so that simpler drive mechanisms can be used. This reduction in mass has decreased the capacity of the materials around the print head to absorb the heat generated by the firing resistors during operation. The result is that unless the transfer of heat from the firing resistors is carefully managed, the ink and the print head may be subjected to wide fluctuations in temperature. These fluctuations in temperature can also result in wide variations in back pressure as the ink heats and cools. The net result is that all of these changes have a degrading affect on print quality.

Accumulators are widely used in hydraulic systems to smooth out pressure fluctuations and to act as shock absorbers against propagating pressure waves. In these applications a compressible gas such as nitrogen or air is used, and the gas is alternately compressed and decompressed as needed. One such use in an ink-jet printing system is disclosed in US Pat. No. 4,223,323 by Bader et al.

While such accumulators work well in those pressure ranges where the gas can be alternately compressed and decompressed, these systems have little affect where the gas is not compressed.

SUMMARY OF THE INVENTION

Briefly and in general terms, an apparatus according to the present invention includes a fluid accumulator forming a portion of the ink containment for a print head. The accumulator changes the volume of the ink containment as the temperature of the ink changes so that the ink remains at substantially constant pressure for delivery to the print head.

In another embodiment, an apparatus according to the present invention includes an ink reservoir containing ink at a pressure P1, an ink-jet print head for printing on a medium with ink at a pressure P2, a pressure regulator connected to both the ink reservoir and the print head so that the regulator receives ink at a pressure P1 from the reservoir and supplies ink at a pressure P2 to the print head, where P1 is larger than P2, and a fluid accumulator operatively connected to the print head so that as the temperature of the ink varies, the ink supplied to the print head remains at substantially constant pressure.

Other aspects and advantages of the invention will become apparent from the following detailed description, taken into conjunction with the accompanying drawings, illustrating by way of example the principles of the invention.

DETAILED DESCRIPTION OF THE INVENTION

Figure 1:
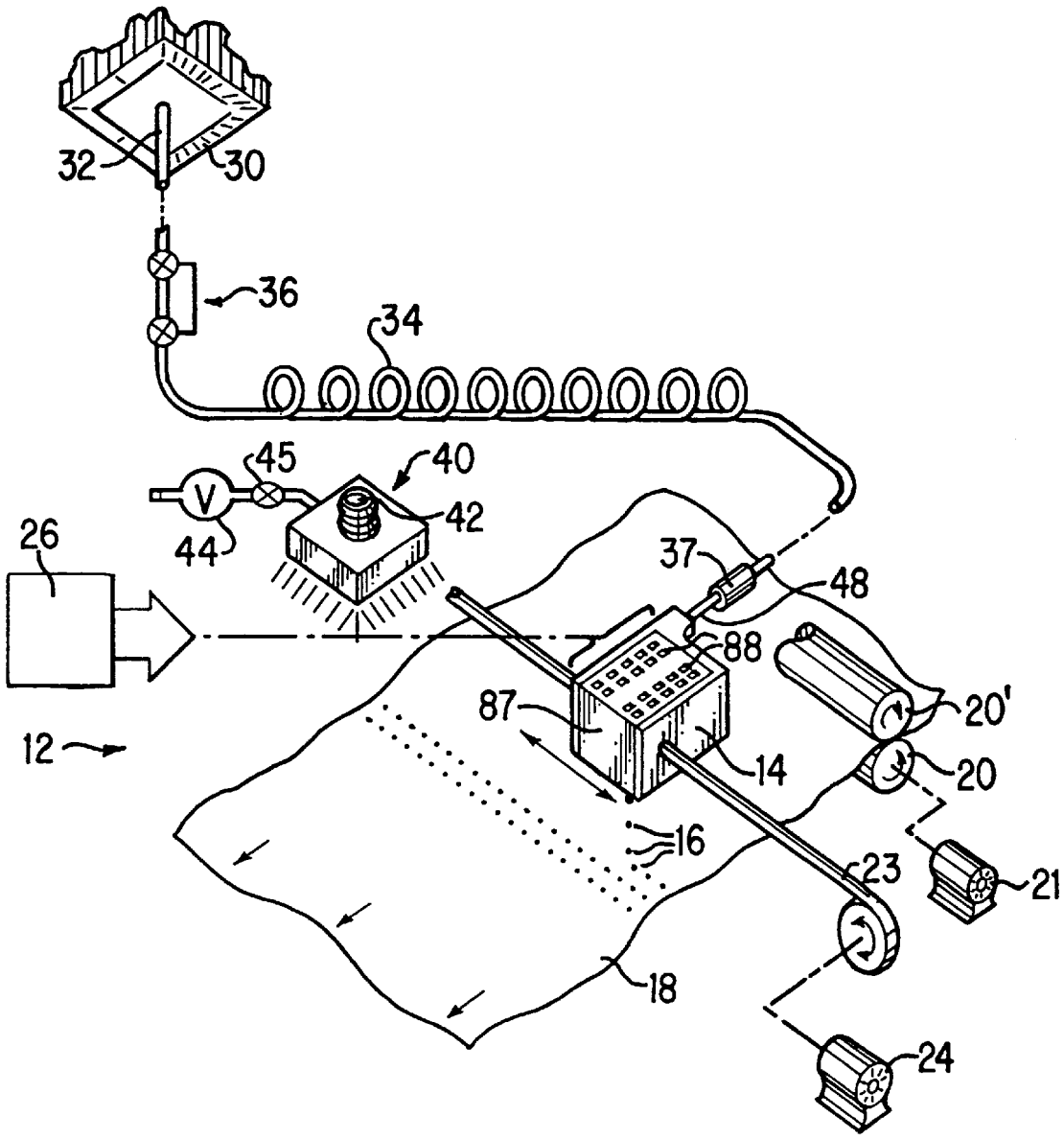
FIG. 1 is a diagrammatic, perspective view of an ink-jet printer according to the present invention.

As shown in the drawings for the purposes of illustration, the invention is embodied in an apparatus for providing ink to an ink-jet print head at substantially constant pressure.

Referring to FIG. 1, reference numeral 12 generally indicates a printer including a print cartridge 14 that ejects drops 16 of ink on command. The drops form images on a printing medium 18 such as paper. The printing medium is moved laterally with respect to the print cartridge 14 by two print rollers 20, 20' and a motor 21 that engages the printing medium. The print cartridge is moved back and forth across the printing medium by a drive belt 23 and a motor 24. The print cartridge contains a plurality of firing resistors, not shown, that are energized on command by an electrical circuit 26. The circuit sequentially energizes the firing resistors in a manner so that as the print cartridge 14 moves laterally across the paper and the paper moved by the rollers 20, 20', the drops 16 form images on the printing medium 18.

Referring to FIG. 1, ink is supplied to the print cartridge 14 from an ink reservoir 30. The ink reservoir is stationary and may be either flaccid or pressurized. The ink is supplied from the reservoir by an integral connector 32 that is removably attached to a conduit 34 by a double acting valve 36. The connector 32 allows the reservoir to be replaced when the ink supply is exhausted. The ink in the reservoir is maintained at a pressure P1 sufficient to maintain the flow of ink through the conduit 34 necessary to meet the maximum ink flow requirements of the print cartridge (which pressure could be from −20 inches to +100 inches of water). This pressure also depends on the diameter and length of the conduit 34. The conduit has a generally helical shape to accommodate the motion of the print cartridge 14 with respect to the ink reservoir 30. When the connector is separated from the conduit, the double acting valve 36 simultaneously shuts both openings so that air is not ingested into the system. Likewise when the connector is fitted to the conduit, the double acting valve simultaneously opens both the connector 32 and the conduit 34 to allow fluid communication of the ink between the ink reservoir 30 and the print cartridge 14 without ingesting air into the system.

The conduit 34, FIG. 1 terminates in a particle filter 37 that collects any material that could clog the print cartridge 14 during operation. The filter is located on the high pressure side of the ink pressure regulator so that if any air is ingested in the reservoir 30, at the double acting valve 36 or in the conduit 34, the air will flow into the print cartridge and will not block the filter or impede the ink flow.

The printer 12, FIG. 1, also includes a service station 40 that can draw a vacuum on the nozzles, not shown, on the print cartridge 14. The service station includes a deformable cup 42 that engages and seals against the nozzles. The cup is connected to a source of vacuum 44 by a valve 45. The service station operates by directing the print cartridge 14 over the cup 42 where a vacuum is drawn on the nozzles and the ink is sucked through the nozzles and out of the cartridge.

Figure 2:
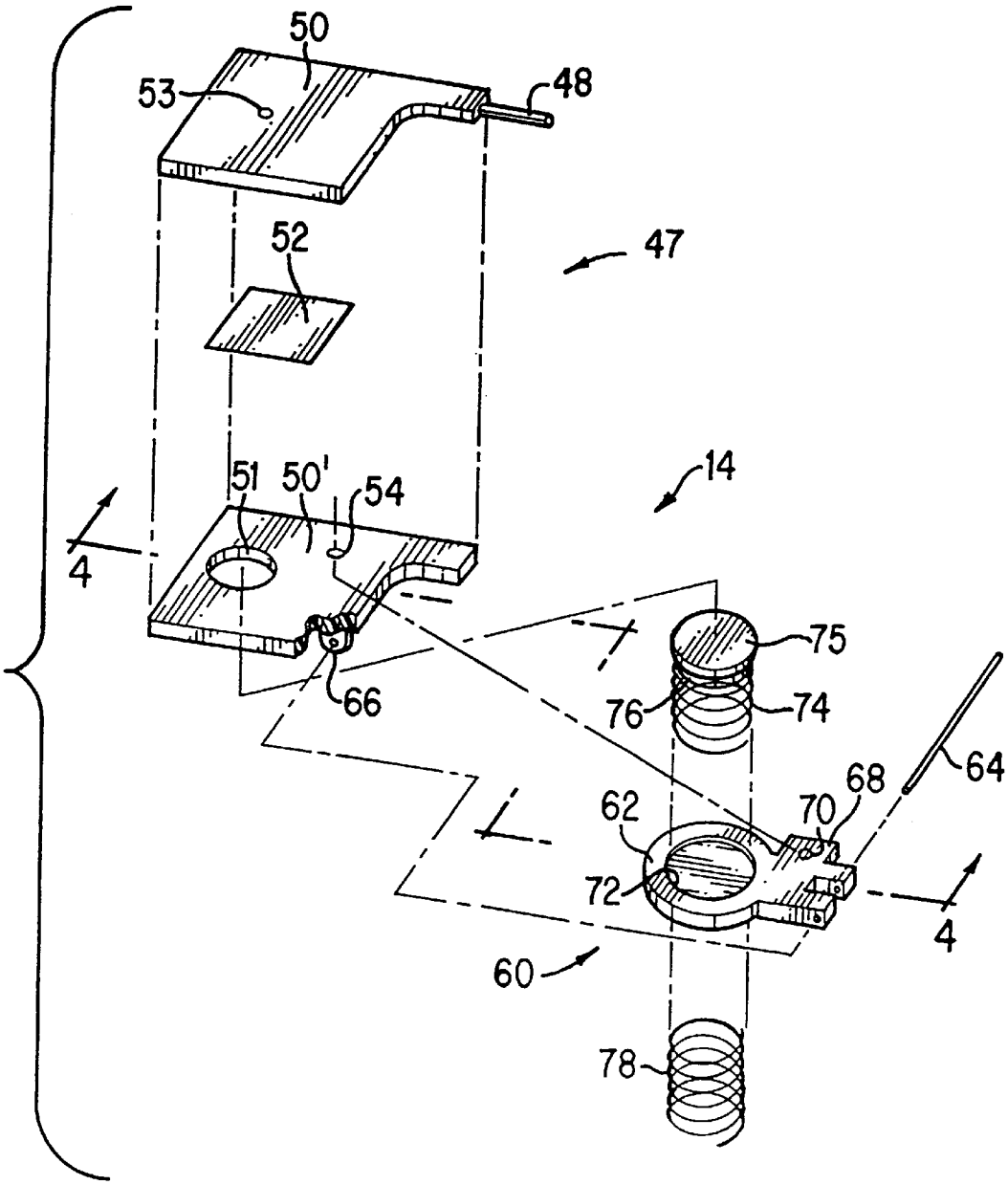
FIG. 2 is an exploded, perspective view of a portion of the print cartridge of FIG. 1.
Figure 3:
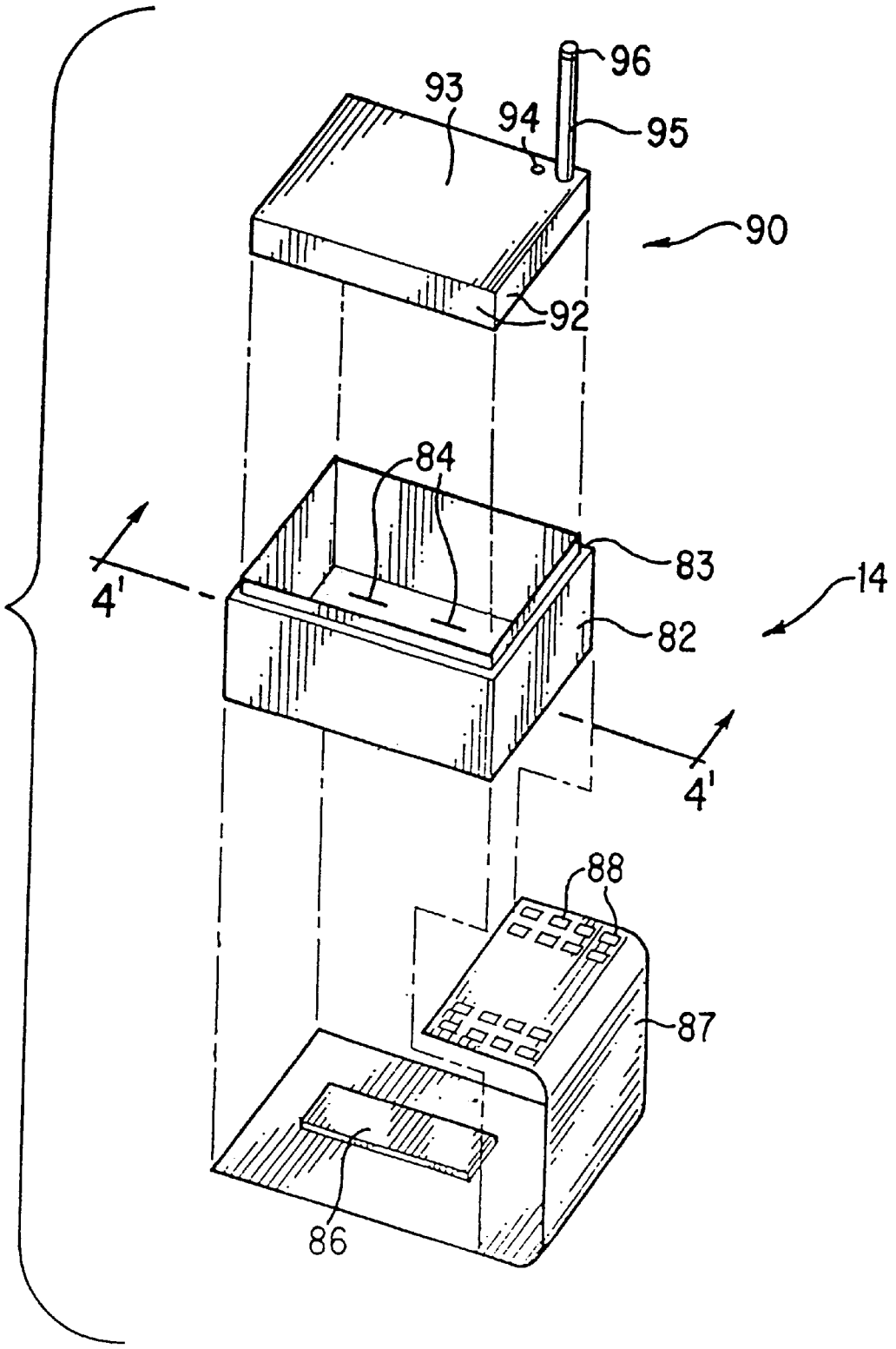
FIG. 3 is an exploded, perspective view of a second portion of the print cartridge of FIG. 1.
Figure 4:
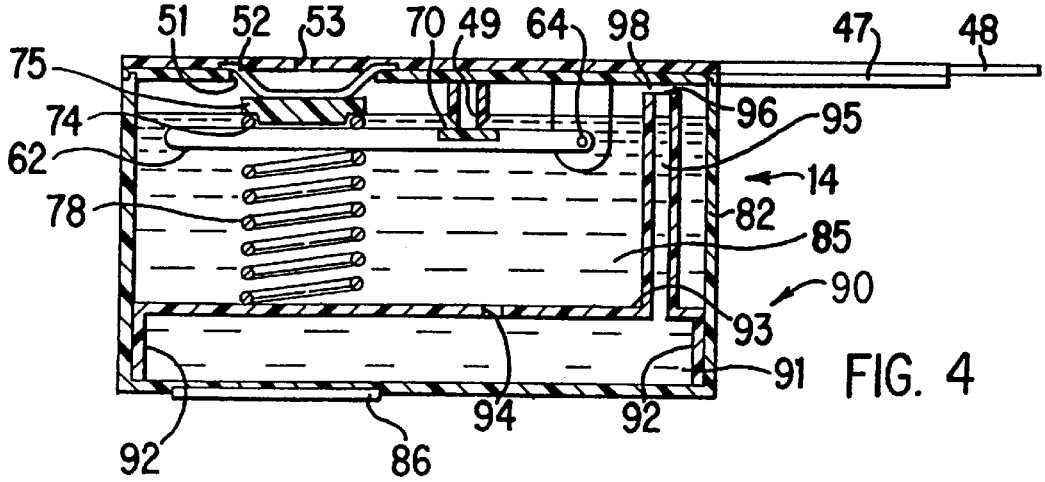
FIG. 4 is a side elevation view, in cross section taken along lines 4—4 and 4'—4' in FIGS. 2 and 3 respectively, illustrating the normal operating position of the pressure regulator.
Figure 5:
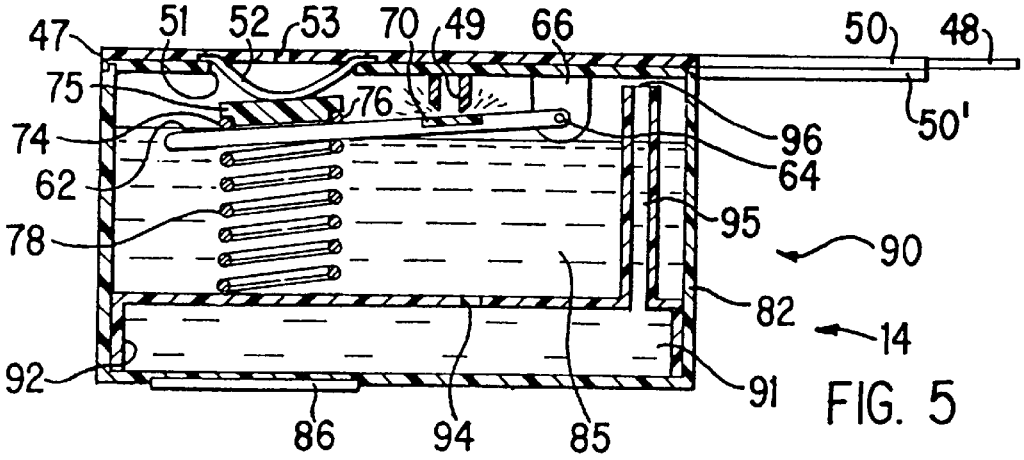
FIG. 5 is a side elevation view, in cross section taken along lines 4—4 and 4'—4' in FIGS. 2 and 3 respectively, illustrating the opening of the orifice of the pressure regulator to allow the entry of ink into the housing of the print cartridge.
Figure 6:
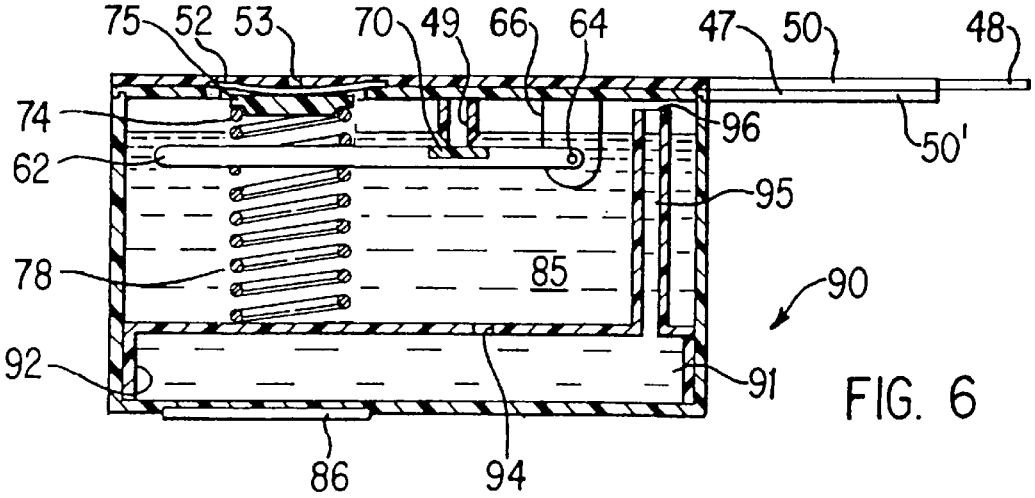
FIG. 6 is a side elevation view, in cross section taken along lines 4—4 and 4'—4' in FIGS. 2 and 3 respectively, illustrating the accumulator accommodating changes in the volume of ink.

The print cartridge 14 of FIG. 1 is shown in two exploded views in FIGS. 2 and 3. The print cartridge includes a top plate 47 that is formed from two contiguous, over-lapping flat panels 50, 50'. The panels form an interior hollow passage 54 for the ink within the top plate. This passage receives an intake tube 48, terminates at an orifice 49, FIG. 5, and distributes ink into the print cartridge. The upper panel 50 of the top plate contains a small vent 53 that communicates with the atmosphere. The lower panel 50' contains a circular opening 51 of substantially larger diameter. Sandwiched and sealed between the panels 50, 50' is a diaphragm 52 that forms a fluid tight seal across the circular opening 51, FIG. 5. The peripheral margin of the diaphragm 52 is thereby sealed against both air and ink. The diaphragm can be fabricated from either thin polyethylene plastic or polyvinyldene fluoride so that the diaphragm is impervious to both air and ink. The diaphragm is deformable and flexible and may be either resilient or not. When a pressure difference is developed across the surface of the diaphragm, the diaphragm expands into the print cartridge as illustrated in FIGS. 4–6. The upper side of the diaphragm is continuously exposed to atmospheric pressure through the vent 53.

Referring to FIG. 2, reference numeral 60 generally indicates a pressure regulator that supports the diaphragm 52 and regulates the pressure of ink supplied into the print head 14. The pressure regulator includes a lever 62 that rotates about an axle 64 that is supported from two supports 66. The supports are mounted on the underside of the lower panel 50' of the top plate 47. The lever also includes an integral arm 68 that contains a valve seat 70 for the ink orifice 49. The valve seat is a flattened, planar surface of room temperature vulcanizing silicone (RTV) and is counter sunk into the surface of the integral arm 68. The lever is aligned so that when the lever 62 is parallel with the plane of the top plate 47, the valve seat 70 is seated and ink orifice 49 is thereby shut as illustrated in FIG. 4.

The lever 62, FIG. 2 engages the diaphragm 52 with a piston 75 and an accumulator spring 74. The accumulator spring 74 is mounted in a circular depression 72 in the lever so that the spring does not move off of the lever 62. The piston is attached to the spring 74 and is held in place by a peripheral, concave engaging surface 76. Referring to FIGS. 4, 5, and 6, the accumulator spring 74 is designed so that a differential pressure across the diaphragm 52 can cause the diaphragm to flex and the piston 75 to move reciprocally up and down without moving the lever 62 and opening the ink inlet valve 49, 70. In FIG. 4 the diaphragm 52 is contracted slightly downward or is more concave in shape. In FIG. 6 the diaphragm is contracted slightly upward or is more planar in shape. The illustrated motion shows a portion of the wall of the ink containment moving and changing the volume of the ink containment. If the print cartridge is subjected to either heating or cooling, the diaphragm flexes to accommodate the change in volume necessary to maintain the pressure of the ink to the print head constant during the temperature transient.

In FIG. 5 the ink valve 49, 70 opens when the piston 75 is forced sufficiently downward by the diaphragm to bottom out against the lever 62 and to mechanically cause its motion. The lever 62 is supported within the print cartridge 14 by a pressure setting spring 78. The pressure setting spring 78 is designed so that its force on the lever 62 is equal to the opening force or cracking force on the ink valve 49, 70. The force of this spring is set to be equal to the area of the diaphragm 52 that is uncovered by the opening 51, FIG. 2, multiplied by the pressure difference between atmospheric pressure and the pressure of the ink supplied to the print head 86, FIG. 5. Typically, this differential pressure is approximately minus three inches (−3") of water. The pressure setting spring 78 is also preloaded so that the force on the lever 62 is essentially constant over the travel of the lever. Such a constant spring force causes the motion of the lever to be large for any given change in the cracking pressure. In other words, a small change in pressure will cause a large movement in the lever. The net result is that when the valve seat 70 is moved off the valve nozzle 49 by a distance equal to approximately the radius of the nozzle 49, the valve will open to full flow condition.

Referring to FIG. 3, the print cartridge 14 further includes a housing 82 that receives the top plate 47 in a step 83 formed in the end of the side walls of the housing. The housing and the top plate together comprise the ink containment for the print head 86. During normal printing operation this containment is the volume that is maintained at constant pressure by the pressure regulator 60, FIG. 2. In the bottom wall of the housing 82 are a plurality of ink feed slots 84 that allow the ink to flow to the print head 86. The print head is a semiconductor substrate on to which are placed the firing chambers, the firing resistors, and the orifice plate in the conventional manner. The print head is mounted on a flexible conductor 87 by tab bonding and electrical signals to the firing resistors are established through the conductors 88, FIGS. 1 and 3.

Referring to FIG. 3, reference numeral 90 generally indicates a primming assembly for removing air from the interior of the print cartridge 14. The priming assembly includes four side walls 92 and a top wall 93 that form an intermediate chamber 91 around the print head 86. These walls support the pressure setting spring 78 above the bottom wall of the housing 82 and also form a secondary differential pressurization area above the print head as described below. The top wall 93 also includes a flow orifice 94 and a snorkel 95. The snorkel is a conduit with an inlet 96 that connects the intermediate chamber 91 with an area 98 in the print cartridge where air gathers. The print cartridge 14 is designed to entrap and to warehouse any air in the cartridge in the area 98. Air is thus stored in an out of the way location so that air and air bubbles do not interfere with the flow of ink during printing.

The flow orifice 94 is sized so that during all printing operations the ink flows to the print head 86 through the orifice 94 and not through the snorkel 95. The orifice is sized so that when printing at maximum ink flow, the orifice has a pressure drop through it that is less than the height of the snorkel 95.

Figure 7:
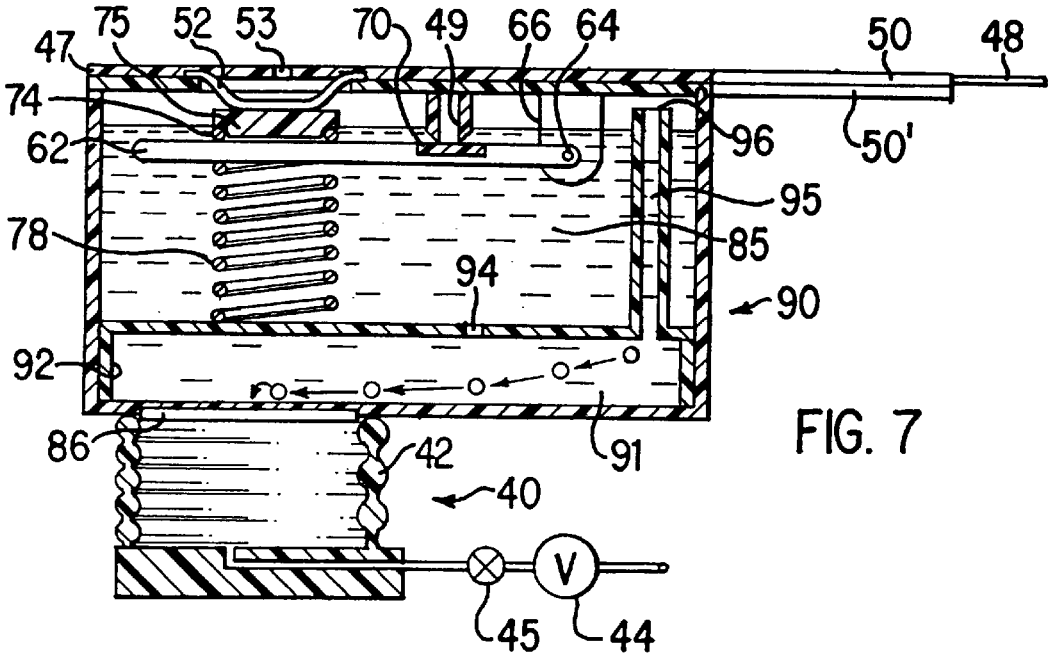
FIG. 7 is a side elevation view, in cross section taken along lines 4—4 and 4'—4' in FIGS. 2 and 3 respectively, illustrating the service station drawing air down the snorkel and out of the print head.

The priming assembly 90, FIG. 7, also includes the service station 40 described above which can engage and seal the print head 86. The service station draws ink out through the print head 86 at a much higher flow rate than during any printing operation. The flow orifice 94 is sized so that under this high ink flow condition, such a large pressure drop is developed across the flow orifice 94 that the ink and air in the top area 98 of the print cartridge are drawn down the snorkel 95 and out the print head 86 as illustrated in FIG. 7.

In operation, the ink reservoir 30, FIG. 1 and the print cartridge 14 are initially filled with ink and sealed. The ink conduit 34 may or may not be filled with ink. To begin, the ink reservoir 30 is connected to the ink conduit 34 by the double acting valve 36. When the printer 12, FIG. 1, commands the print cartridge 14 to commence ejecting drops 16, FIG. 1, ink flows through the conduit 34 and any air in the conduit flows into the print cartridge and becomes trapped in the top area 98 of the housing. As illustrated in FIG. 4, at this point the print cartridge has a slight air bubble 98 in the top of the housing, the ink orifice 49 is shut by the lever 62, the diaphragm 52 is slightly concave, and any ink flow to the print head 86 is passing through the flow orifice 94.

As the print head 86, FIG. 5 continues to eject drops of ink on command from the printer, the pressure of the ink in the print cartridge 14 drops. In this embodiment the differential pressure across the cartridge goes more negative than minus three inches (−3") of water. The diaphragm 52 becomes more concave due to differential pressure between atmospheric pressure in the vent 53 and the pressure in the housing 82. This drop in pressure continues until the piston 75, FIG. 5, bottoms out against the lever 62 and then the diaphragm forces the piston to move the lever and to open the orifice 49 as illustrated in FIG. 5. This is rotational motion of the lever 62 around the axle 64, FIG. 5. The point at which the orifice 49 opens is the "cracking pressure" and is determined by the pressure setting spring 78. Ink then flows into the print cartridge 14, the pressure in the print cartridge is restored, and any air is collected in the area 98. When the differential pressure across the diaphragm 52 decreases due to the inflow of the ink, the piston 75 allows the lever to shut the orifice 49 and the flow of ink into the print cartridge stops.

If the temperature of the print cartridge goes up due, for example, to operation of the print head, this could cause either the pressure of the ink in the housing 82 to rise or the volume of air to increase. As discussed above, a wall portion of the ink containment moves to accommodate this increase in temperature. The diaphragm 52 flexes upward as illustrated in FIG. 6 and becomes more planar to maintain the pressure within the housing constant. If there is a decrease in temperature, the diaphragm flexes downward and becomes more concave to maintain constant pressure. This is relative motion between the piston 75 and the lever 62 and is permitted by the accumulator spring 74. The lever 62 is remains stationary and is unaffected by such temperature excursions.

Figure 8:
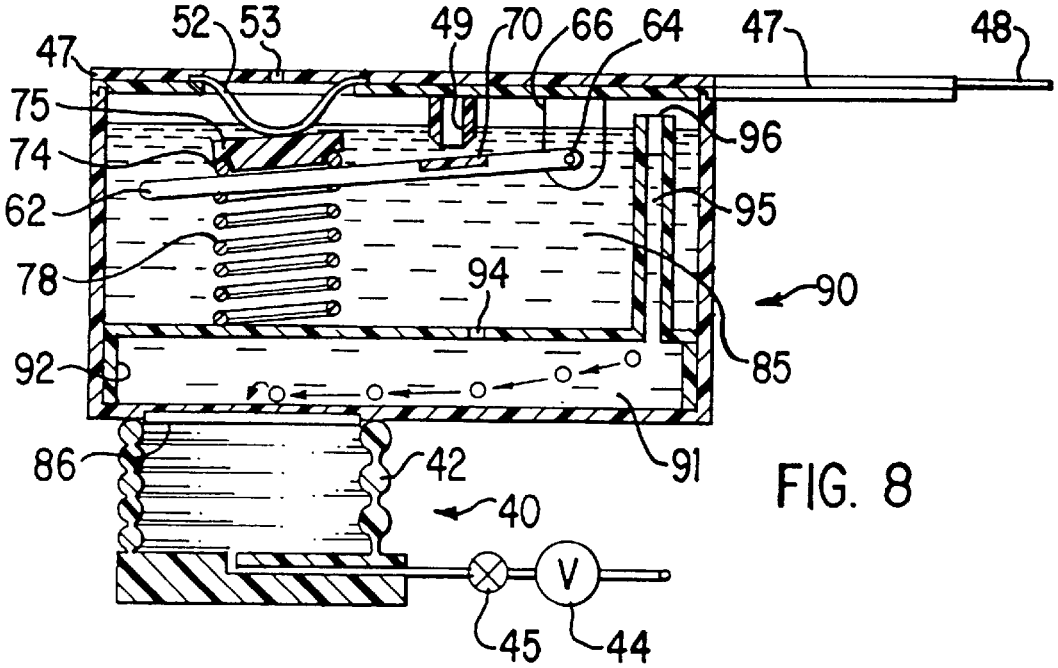
FIG. 8 is a side elevation view, in cross section taken along lines 4—4 and 4'—4' in FIGS. 2 and 3 respectively, illustrating the service station drawing air down the snorkel and out of the print head as the orifice of the pressure regulator opens to allow the entry of ink into the housing of the print cartridge.

To remove any air from the top area 98 of the housing 82, the print cartridge 14 is purged using the service station 40. Referring to FIGS. 7 and 8, a vacuum 44 is applied to the nozzles of the print head 86 and a very high flow rate is induced through the print cartridge. Any air in the print cartridge is drawn down the snorkel 95 as illustrated in FIG. 7 instead of the flow orifice 94 because of the small size of the flow orifice and the large pressure drop across it. The volume of air drawn down the snorkel and out of the housing is replaced by a fluid volume of ink because the differential pressure in the housing drops and the orifice 49 opens as illustrated in FIG. 8. The result is to rapidly prime the print cartridge with ink and to remove the air from the system.

Figure 9:
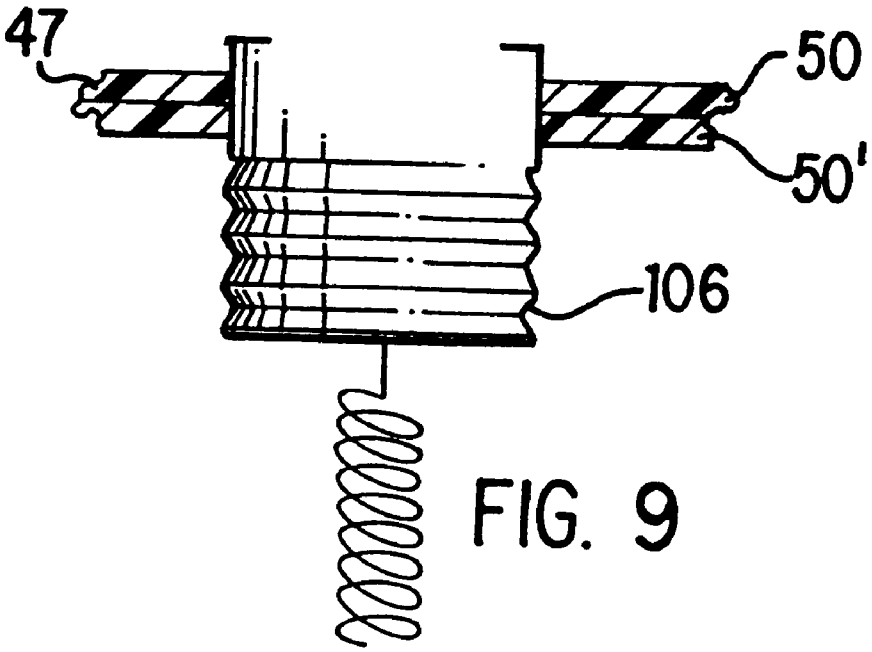
FIG. 9 is a side elevation view, in cross section, illustrating a bellows operating as an accumulator.
Figure 10:
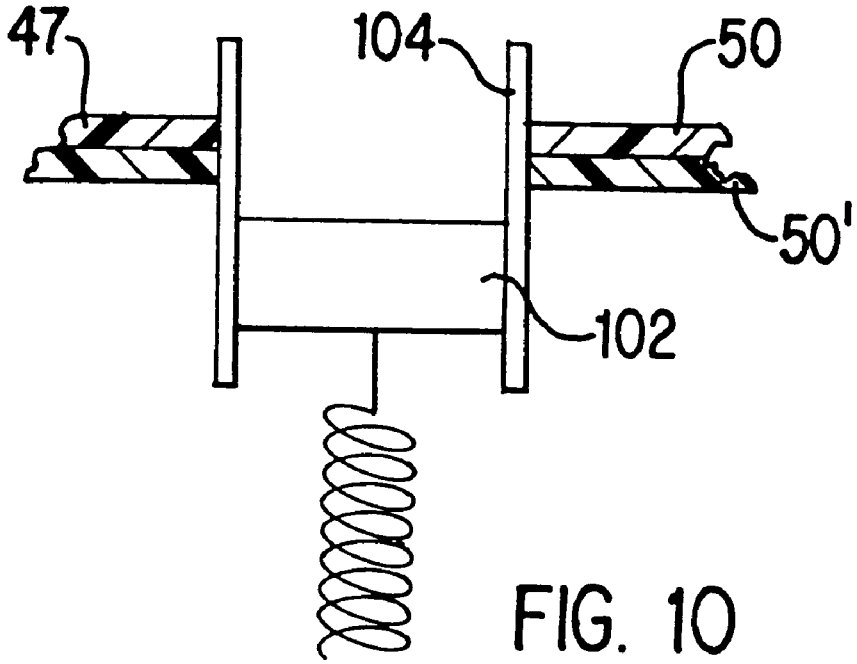
FIG. 10 is a side elevation view, in cross section, illustrating a piston operating as an accumulator.

Although specific embodiments of the invention have been described and illustrated, the invention is not limited to the specific forms or arrangement of parts so described and illustrated herein. Referring to FIG. 9 and 10 it is contemplated that the diaphragm 52 could be replaced by a piston 102 sliding reciprocally in a cylinder 104 or a bellows 106 urged in a direction to maintain the ink at a substantially constant pressure. The invention is limited only by the claims.

I claim:

1. A printing system, comprising:

a) a print cartridge including an ink jet print head, an ink receptacle in fluid communication with said print head, and an ink input port in fluid communication with said ink receptacle, said ink receptacle containing ink at a first pressure;

b) an ink container external to said print cartridge, said ink container containing ink at a second pressure, where said second pressure is greater than said first pressure;

c) a conduit for transporting ink from said ink container to said print cartridge; and d) a pressure regulator disposed in said ink receptacle, coupled to said ink input port and in communication with an atmospheric air pressure, said pressure regulator receiving ink via said ink input port at said second pressure from said ink container, supplying ink at said first pressure to said print head, and accommodating a pressure difference between said first pressure and said atmospheric pressure, said pressure regulator opening said ink input port when said first pressure in said ink receptacle is sufficiently less than said atmospheric air pressure and changing a volume of said ink receptacle without opening said ink input port when said first pressure changes relative to said atmospheric air pressure due to changes in print cartridge temperature;

wherein said ink input port comprises an ink orifice disposed within said print cartridge and wherein said pressure regulator comprises a lever including an arm rotating about an axle and a valve seat disposed on said arm opposite said ink orifice such that said ink orifice is blocked by said valve seat when said arm is in a first position and not blocked by said valve seat when said arm is in a second position corresponding to an opening of said ink input port;

wherein said pressure regulator comprises a spring coupled to said arm and an expandable and contractible member coupled to said atmospheric air pressure and coupled to said arm in opposition to said spring, to detect when said first pressure is less than said atmospheric air pressure, wherein said arm is rotated about said axle to unblock said ink orifice when said first pressure is sufficiently less than said atmospheric air pressure.

2. A printing system in accordance with claim 1 wherein said expandable and contractible member is disposed within said ink receptacle and moveable between an increased volume position and a decreased volume position within said ink receptacle, wherein as said first pressure moves toward lower pressures, said atmospheric air pressure causes said expandable and contractible member to expand and occupy an increased volume within said ink receptacle and as said first pressure moves toward higher pressures, said atmospheric air pressure causes said expandable and contractible member to contract and occupy a decreased volume within said ink receptacle.

3. A printing system in accordance with claim 1 wherein said pressure regulator further comprises said arm rotatable about said axle at a first end, coupled to said expandable and contractible member at a second end, and urging said valve seat against said ink orifice from a position between said first and second ends.

4. A printing system in accordance with claim 1 wherein said spring further comprises a spring preloaded for an essentially constant force over a predetermined distance.

5. A printing system in accordance with claim 1 wherein said pressure regulator further comprising an accumulator spring disposed between said expandable and contractible member and said arm.

6. A pressure regulator for a fluid ejecting cartridge, said pressure regulator disposed within a fluid receptacle of the cartridge, comprising:

a valve including a fluid orifice and a valve seat;

a pressure setting spring;

an expandable member attached to a wall of the fluid receptacle, coupled to atmospheric air pressure outside of the fluid receptacle, and adapted to expand into the fluid receptacle and reduce the volume of the fluid receptacle when a pressure difference develops between said atmospheric air pressure and a fluid contained by said fluid receptacle;

a lever arm pivoted at a first end, coupled at a second end to said expandable member and said pressure setting spring, and urging said valve seat against said fluid orifice from a position between said first and second ends;

wherein said expandable member expands without pivoting said lever arm when said pressure difference is less than a predetermined value, and pivoting said lever arm and moving said valve seat away from said fluid orifice when said pressure difference is greater than said predetermined value.

7. A pressure regulator in accordance with claim 6 further comprising an accumulator spring disposed between said expandable member and said lever arm at said second end.

8. A pressure regulator in accordance with claim 6 wherein said pressure setting spring further comprises a spring preloaded for an essentially constant force over a predetermined distance of lever arm travel.

* * * * *